US009044072B2

(12) United States Patent
Lindsay, Jr. et al.

(10) Patent No.: US 9,044,072 B2
(45) Date of Patent: Jun. 2, 2015

(54) HIKING AND SURVIVAL STAFF

(71) Applicants: Crolie E. Lindsay, Jr., Modesto, CA (US); Rodney A. Lindsay, Modesto, CA (US)

(72) Inventors: Crolie E. Lindsay, Jr., Modesto, CA (US); Rodney A. Lindsay, Modesto, CA (US)

( * ) Notice: Subject to any disclaimer, the term of this patent is extended or adjusted under 35 U.S.C. 154(b) by 79 days.

(21) Appl. No.: 13/761,111

(22) Filed: Feb. 6, 2013

(65) Prior Publication Data

US 2013/0327367 A1 Dec. 12, 2013

Related U.S. Application Data

(60) Provisional application No. 61/595,368, filed on Feb. 6, 2012.

(51) Int. Cl.

| | |
|---|---|
| ***A45B 3/00*** | (2006.01) |
| ***A45B 9/00*** | (2006.01) |
| ***A45B 3/14*** | (2006.01) |
| ***A45B 9/02*** | (2006.01) |
| ***E04H 15/30*** | (2006.01) |
| *A45B 3/04* | (2006.01) |

(52) U.S. Cl.
CPC ... *A45B 3/14* (2013.01); *A45B 9/00* (2013.01); *A45B 3/00* (2013.01); *A45B 9/02* (2013.01); *A45B 3/04* (2013.01); *E04H 15/30* (2013.01)

(58) Field of Classification Search
CPC ..... A61H 3/02; A45B 3/00; A45B 9/00
USPC ..... 135/65–66, 69, 72, 114; 280/819, 820, 280/823; 403/109.5, 409.1
See application file for complete search history.

(56) References Cited

U.S. PATENT DOCUMENTS

| | | | | |
|---|---|---|---|---|
| 1,509,157 | A * | 9/1924 | Leano | 135/66 |
| 2,445,344 | A * | 7/1948 | Wachtel | 280/812 |
| 4,229,015 | A * | 10/1980 | Ramsey et al. | 280/819 |
| 4,314,575 | A * | 2/1982 | Kuo | 135/66 |
| 4,351,348 | A * | 9/1982 | Axton | 135/66 |
| 4,407,318 | A * | 10/1983 | Stuever | 135/66 |
| 5,482,071 | A * | 1/1996 | Liu | 135/66 |
| 5,653,468 | A * | 8/1997 | Ostapyk | 280/809 |
| 5,788,608 | A * | 8/1998 | Wilkinson | 482/51 |
| 6,328,048 | B1 * | 12/2001 | Rivera, Sr. | 135/66 |
| 6,539,965 | B1 * | 4/2003 | White, III | 135/66 |
| 6,711,772 | B2 | 3/2004 | Grassi | |
| 6,745,785 | B2 * | 6/2004 | Kotovsky | 135/65 |
| 6,772,778 | B2 * | 8/2004 | Morosini et al. | 135/65 |
| 6,948,208 | B1 * | 9/2005 | Schlenner | 7/116 |
| 6,957,492 | B1 * | 10/2005 | Westfall | 30/151 |
| 8,832,980 | B2 * | 9/2014 | Hill | 40/606.12 |
| 2002/0104560 | A1 * | 8/2002 | Kelley | 135/66 |
| 2005/0211284 | A1 * | 9/2005 | Dooley | 135/65 |
| 2006/0090783 | A1 | 5/2006 | King-Fai | |
| 2007/0170713 | A1 * | 7/2007 | Berutti | 280/819 |
| 2010/0175728 | A1 * | 7/2010 | Warren | 135/65 |
| 2011/0139201 | A1 | 6/2011 | Haddad | |
| 2012/0098282 | A1 * | 4/2012 | Langan | 294/49 |

* cited by examiner

*Primary Examiner* — Winnie Yip
(74) *Attorney, Agent, or Firm* — Stuart J. West; Shaun N. Sherman; West & Associates, A PC

(57) ABSTRACT

A hiking staff having one or more hollow interiors shaped to support a user's body weight when hiking. Survival gear, such as first aid supplies, a tent, and/or provisions for defense or food gathering needs, can be stored within the hollow interiors of the hiking staff. End caps enclosing the open ends of the hiking staff can be selectively removed to access the survival gear. A knife can be coupled with an end of the hiking staff for storage and/or use of the hiking staff as a spear.

3 Claims, 8 Drawing Sheets

HIKING AND SURVIVAL STAFF

CLAIM OF PRIORITY

This Application claims priority under 35 U.S.C. §119(e) from earlier filed U.S. Provisional Application Ser. No. 61/595,368, filed Feb. 6, 2012, by Crolie E. Lindsay, Jr. and Rodney A. Lindsay, the entirety of which is incorporated herein by reference.

BACKGROUND

1. Field of the Invention

The present invention relates to walking sticks. More particularly, the invention relates to hiking staffs that include storage for survival equipment and related items.

2. Background

Hiking typically requires traversing over rough natural terrain such as desert and mountainous environments that require movement around or over rocks, boulders, and gullies. A hiker is often faced with crossing creeks, streams or ravines. Heavy vegetation may also be encountered. Walking sticks and hiking staffs have been used for centuries to aid hikers on treks across all types of terrains.

According to the United States Forest Service's August 2012 Recreation Statistics Update, 81.3 million people participated in day hikes within parks operated by the U.S. Department of Agriculture. Many more take hikes in other areas. Increasingly, hiking sticks and/or staffs are used as aids in these outings. In years past, wooden sticks found along trails were the primary source for these walking aids. Often such sticks were carved or decorated and were used repeatedly over time. More recently, fiberglass, aluminum, and other materials have been used in walking sticks. These types of sticks can often be lightweight, of tubular construction, and can provide for adjustments in length. See, for example, U.S. Pat. No. 4,351,348 to Axton and U.S. Pat. No. 4,407,318 to Stuever.

A drawback of wooden sticks is the potential for failure or breakage. Adjustable walking sticks can be subject to slippage; therefore limited weight should be applied to these for support. Conventional walking sticks tend to be short, such as waist high, and while they can provide a light weight support, they lack the ability to provide adequate support when traversing over large objects, through dense vegetation, or when crossing creeks, streams or gullies.

Every year thousands of people get lost while hiking. *VIA Magazine*, AAA, July/August, 1998. As pointed out in Dooley's U.S. Patent Application Pub. No. U.S. 2005/0211284 A1, many survival devices have been developed to provide aid in keeping one alive until rescued. Most of these, however, including the last above referenced, can be cumbersome such that they are likely to be left behind by a hiker. This is particularly true for 'day hikers' who tend to minimize concern for the potential of injury or the likelihood of becoming lost or stranded.

Conventional survival devices also do not include sufficient features for sustaining life for an adequate period of time, such as addressing the need for real shelter or providing alternative ways to secure food and defend oneself from the dangers of the wild. The storage capacity of these survival devices tend to be limited, such that there is not enough storage volume to hold sufficient survival features within the survival device. For example, hikers may need shelter, particularly when they become lost or unexpectedly stranded by weather or other circumstances. While some survival devices have or suggest using a sheet of thin plastic for shelter and a space blanket for cover, both are only token efforts to protect one from the elements in severe situations. None have provisions for support or anchorage of such materials. Similarly, although Haddad's U.S. Patent Application Pub. No. 2011/0139201 A1 teaches a walking stick comprising a defensive weapon, the weapon's practicality is limited for emergency use. It also lacks alternative applications, which can be important because the need for minimum weight is a major factor in practical use of a survival device such as a hiking staff. Concern for weight is also an issue when attempting to include multiple electronic devices in the storage capacity of a survival device, especially when such items are often already included in cell phones and GPS units used by today's hikers. The additional weight of these electronic components in a hiking staff carried in the hand would be wearisome, and therefore, they are not practically contained in a trekking staff.

What is needed is a survival device in the shape of a hiking stick or staff that can carry survival gear inside it and be readily available to the average hiker. Unlike hiking staffs such as the one disclosed in Haddad's U.S. Patent Application Pub. No. 2011/0139201 A1, the hiking staff should carry survival gear inside the staff such that the survival gear can be protected from the elements until they are needed. The hiking staff should be strong yet light in weight, require minimal fabrication or milling, and should not require special knowledge to use. It should demand little maintenance, have no recharge requirements, and be 'ready to go' at a moment's notice.

BRIEF SUMMARY OF THE INVENTION

The present invention is a hiking staff that can have strength and durability characteristics such that it can be capable of carrying a user's body weight when the user crosses over rocks, streams, gullies, or other terrain. The hiking staff can be lightweight and comfortable enough to be used for hiking over significant distances, yet be strong enough to withstand the elements without regular maintenance requirements. The hiking staff can be at least partially hollow, such that there is internal storage capacity in the hollow space. Sufficient internal volume can be available to carry a significant variety of first aid equipment, survival supplies, shelter, defense and food gathering items, and other supplies which may be required by an individual user when confronted with a true survival situation. The internal storage capacity can protect the contents from damage, water, dust, and other nuisances. Removable end caps can protect and secure survival products and gear within the hiking staff. The end caps can have a blunt end surface that can minimize penetration into soft soils, provide a non-skid surface, and/or reduce the possibility getting the hiking staff wedged in cracks or fissures while hiking. The hiking staff can have a cushioned handle, which can provide comfort to a user. The hiking staff can be a single piece, or it can be segmented such that it can be broken down for ease in transport and can be reassembled using a spring loaded latch, such that the segments remain coupled together during the course of a hike. When broken down, the survival supplies can be easily accessed at each end of each segment of the hiking staff.

The hiking staff can also include survival gear such as a tent stored inside the staff for shelter, a sleeping bag, first aid kit, a knife, and/or other survival items. The hiking staffs knife can be used as a normal knife, or as a spear point to provide the hiking staff with offensive and defensive capabilities as a spear. The spear can also be shortened to a single portion of the segmented hiking staff for protection while inside the tent or in confined areas. The bottom of the tent can display a survival message, such the word 'HELP," so that it can be placed in an open area when seeking help from aerial craft. While the tent can be designed to be stored inside the staff, it can be otherwise folded and carried in a 'fanny pack', thus allowing alternative additional storage, or reducing the weight of the loaded staff.

DETAILED DESCRIPTION

Figure 1:
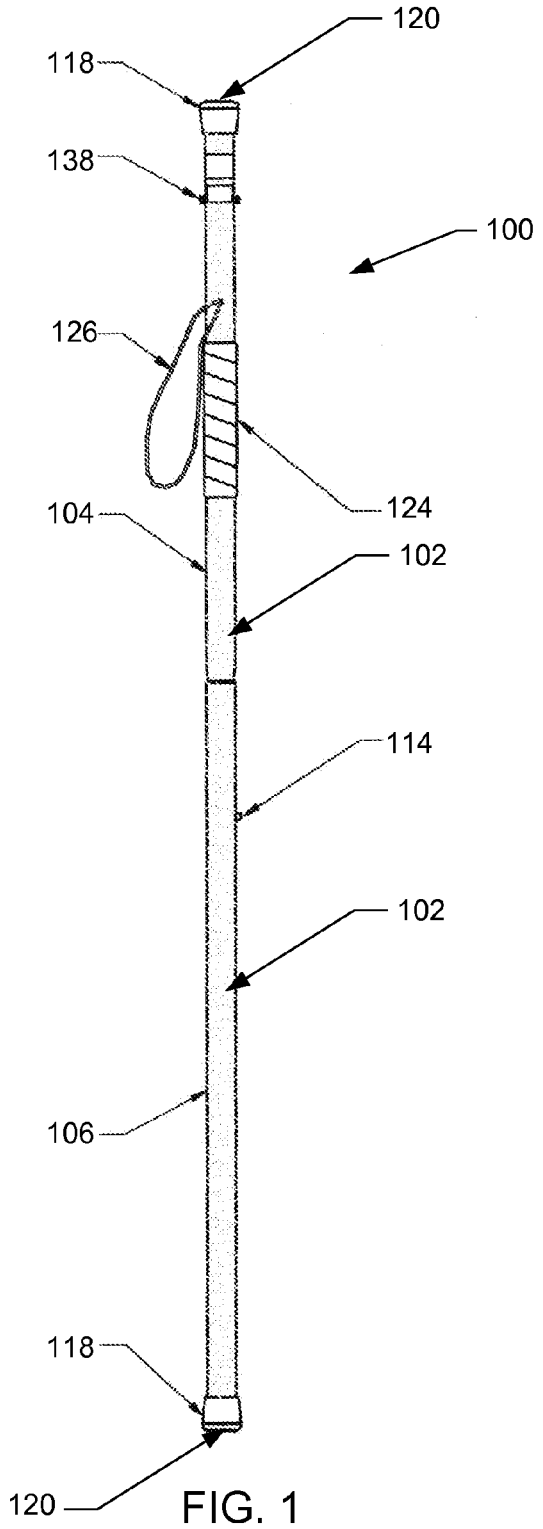
FIG. 1 depicts an external profile view of a hiking staff having multiple segments.

FIG. 1 depicts an external profile view of a hiking staff 100. The hiking staff 100 can be an elongated member. The hiking staff 100 can have any desired shape or size. By way of non-limiting examples, in some embodiments the hiking staff 100 can be a cylindrical tube having an exterior diameter of 1.5 inches, 1.375 inches, or any other desired diameter. The hiking staff 100 can have any desired length. In some embodiments, the hiking staff 100 can have an adjustable length. In alternate embodiments, the hiking staff 100 can have a fixed length. By way of a non-limiting example, in some embodiments the length of the hiking staff 100 can be fixed at sixty four inches.

In some embodiments, the hiking staff 100 can comprise multiple staff sections 102. By way of a non-limiting example, in the embodiments shown in FIGS. 1-3, the hiking staff comprises an upper staff section 104 and a lower staff section 106. In alternate embodiments, the hiking staff 100 can comprise any number of staff sections 102. In some embodiments, the staff sections 102 can be made of aluminum. In alternate embodiments, the staff sections 102 can be made of fiberglass, carbon fiber, steel, plastic, wood, metal, metal alloy, or any other material or combination of materials. In some embodiments, the exteriors of the staff sections 102 can be colored, have designs such as a camouflage pattern, or have any other finish or paint.

Figure 2:
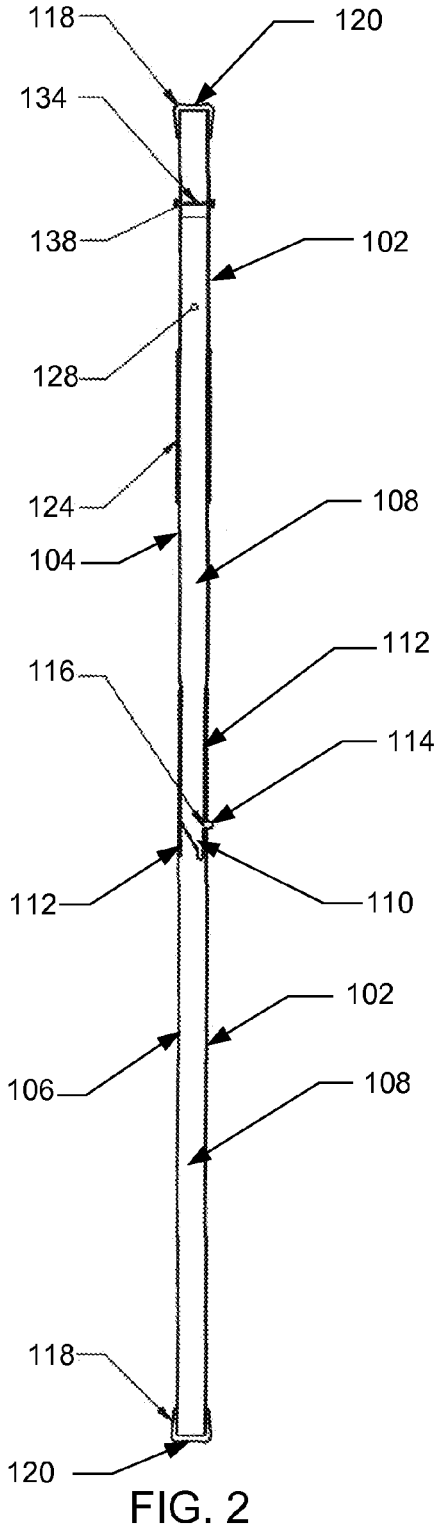
FIG. 2 depicts a cross section of a hiking staff.
Figure 3:
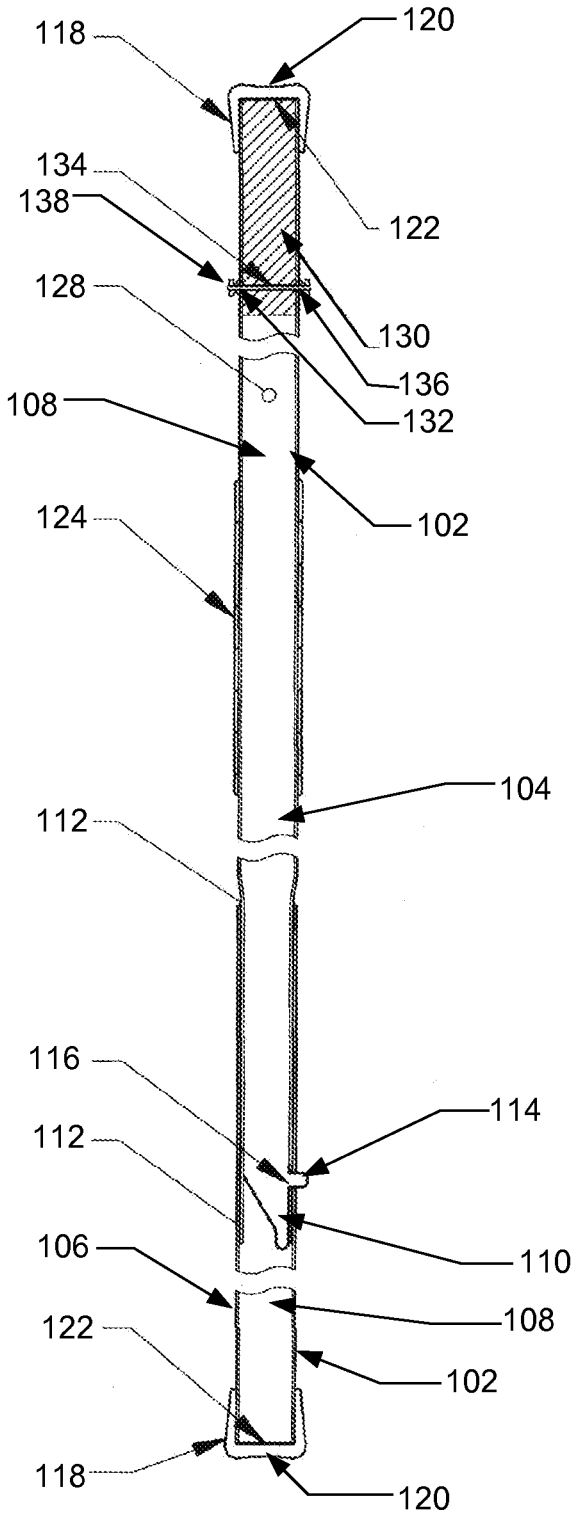
FIG. 3 depicts details of a cross section of a hiking staff.

In some embodiments, the staff sections 102 can have walls surrounding hollow interiors 108, as shown in FIGS. 2 and 3. One or both ends of the staff sections 102 can be open into the hollow interiors 108. The walls of the staff section 102 can have any desired thickness between the staff section's exterior and hollow interior 108. By way of a non-limiting example, in some embodiments one or more portions of the walls of the staff section 102 can have a thickness of 0.058 inches between the exterior of the staff section 102 and the hollow interior 108. As another non-limiting example, in other embodiments one or more portions of the walls of the staff section 102 can have a thickness of 0.065 inches between the exterior of the staff section 102 and the hollow interior 108.

In some embodiments, the exterior and exterior diameters of the hiking staff 100 and/or each staff section 102 can be consistent throughout the length of the hiking staff 100. In alternate embodiments, the hiking staff 100 and/or individual staff sections 102 can have one or more tapered sections, and/or sections with different internal and/or external diameters than other sections. By way of a non-limiting example, in some embodiments, the hiking staff 100 can comprise a middle staff section 102 having a larger exterior diameter than an upper staff section 102 and a lower staff section 102.

FIG. 2 depicts a cross section of an embodiment of the hiking staff 100, and FIG. 3 depicts close-up views of portions of the cross section of the hiking staff 100. In some embodiments, the ends of the staff sections 102 can be shaped such that one staff section 102 can be inserted into the hollow interior 108 of a different staff section 102 to couple the staff sections 102 with each other substantially end to end. By way of a non-limiting example, the upper staff section 104 shown in FIG. 2 can have a tapered and angled end 110 that can be inserted into the hollow interior 108 of the lower staff section 106. In some embodiments, the exterior of the end 110 of the upper staff section 104 and/or a portion of the hollow interior 108 of the lower staff section 106 can have a lining 112. The lining 112 can create a snug fit between the staff sections 102. In some embodiments and/or situations, the lining 112 can suppress noise and/or rattling during operation of the hiking staff 100. The lining 112 can be comprised of rubber, vinyl, neoprene, and/or any other material.

In some embodiments, the staff sections 102 can be coupled together with a spring latch 114 that can protrude from one staff section 102 through an aperture 116 on the other staff section 102. In some embodiments, a staff section 102 can have a plurality of apertures 116, such that the spring latch 114 can be extended through any aperture 116 as desired to adjust the overall length of the hiking staff 100. In alternate embodiments, the staff sections 102 can have threads and grooves such that the staff sections 102 can be screwed together. In still other embodiments, the staff sections 102 can be coupled via friction fit, bolts, pins, wingnut screws, or any other connection method.

The opposing ends of the hiking staff 100 can each be coupled with an end cap 118. In some embodiments, the end caps 118 can enclose the open ends of the staff sections 102. By way of a non-limiting example, an end cap 118 can enclose the open bottom end of the lower staff section 106. In some embodiments, the end caps 118 can have a blunt foot 120 on the side of the end cap 118 that faces away from the hiking staff 100. The blunt foot 120 can be shaped to reduce the chances that the hiking staff 100 can penetrate into soft soils or get wedged into cracks or fissures. In some embodiments, the end caps 118 can be rubber. In alternate embodiments, the end caps 118 can be metal, plastic, wood, or any other desired material. In some embodiments, the blunt foot 120 can have a non-skid surface. In some embodiments, the end caps 118 can be waterproof and/or water resistant, and/or form a seal around the open end of the staff section 102, such that moisture, dust, and debris is prevented from entering the hollow interiors 108 of the hiking staff 100.

In some embodiments, the end caps 118 can be selectively removable from the hiking staff 100 to expose the hollow interiors 108 of the staff sections 102, such that survival gear 500 can be enclosed, stored, and/or protected within the hiking staff 100 when the end caps 118 are coupled with the hiking staff 100, and the survival gear 500 can be accessible to a user when the end caps 118 are removed from the hiking staff 100. In some embodiments, the end caps 118 can be coupled with the ends of the hiking staff 100 via friction fit. In alternate embodiments, the end caps 118 can be screwed onto the ends of the hiking staff 100, fit into notches on the hiking staff 100, fit over protrusions on the hiking staff 100, be hingeably connected to the hiking staff 100 with hinges, or be coupled with the hiking staff 100 using any other method.

In some embodiments, each end cap 118 can comprise a stabilizing disc 122 on its interior. In some embodiments, the stabilizing disc 122 can reduce wear on the end cap 118 from impact forces from the hiking staff 100 during use. The stabilizing disc 122 can have a diameter equal to the outside diameter of the hiking staff 100, such that an end of a staff section 102 can meet the edges of the stabilizing disc 122 without the stabilizing disc 122 entering the hollow interior 108 of the staff section 102. In some embodiments, the stabilizing disc 122 can be aluminum. In other embodiments, the stabilizing disc 122 can be any other type of metal, plastic, wood, or other desired material. In some embodiments, the stabilizing disc 122 can be coupled with the interior of the end cap 118 via a waterproof sealant. In other embodiments, the stabilizing disc 122 can be coupled with the interior of the end cap 118 via adhesive, friction fit, press fit, or any other connection mechanism.

In some embodiments, one or more staff sections 102, such as the upper staff section 104 shown in FIG. 1, can comprise a handle portion 124. The handle portion 124 can be coupled with at least a part of the exterior of the staff section 102. In some embodiments, the handle portion 124 can be a cushioned material such as foam, neoprene, or any other soft material. In alternate embodiments, the handle portion 124 can be tape, leather, vinyl, or any other material that can be affixed to or wrapped around the staff section 102.

In some embodiments, one or more staff sections 102 can comprise a strap 126. In some embodiments, the strap 126 can be coupled with the staff section 102 at or substantially near the handle portion 124. In some embodiments, the strap 126 can be leather. In alternate embodiments, the strap 126 can be rope, string, cord, elastic, or any other material. In some embodiments, the strap 126 can be coupled with the staff section 102 by inserting the strap 126 through a hole 128 on the staff section 102 and tying the strap 126 with a knot inside the hollow interior 108 of the staff section 102, such that the knot cannot pass through the hole 128. In alternate embodiments, the strap 126 can be coupled with the staff section 102 with adhesives, fusing, knots, or any other connection method.

In some embodiments, a knife holder 130 can be coupled with the hollow interior 108 of one or more staff sections 102, such as in the upper staff section 104, as shown in FIG. 3. The knife holder 130 can have the same diameter as the hollow interior 108 of the staff section 102. The knife holder 130 can have an aperture 132 extending transversely through the knife holder 130. In some embodiments, a threaded stud 134 can be inserted through apertures 136 in the staff section 102 and through the aperture 132 in the knife holder 130. The threaded stud 134 can be secured with kurled nuts 138 on opposing sides of the staff section 102. In alternate embodiments, the knife holder 130 can be coupled with the staff section 102 by extending a pin though the apertures 132 and 136, screwing the pieces together, friction fitting the pieces together, attaching the knife holder 130 to notches in the staff section 102, with a spring latch, or through any other connection method. In some embodiments, the knife holder 130 can be wood. In alternate embodiments, the knife holder 130 can be aluminum, plastic, metal, carbon fiber, rubber, or any other material.

Figure 4A:
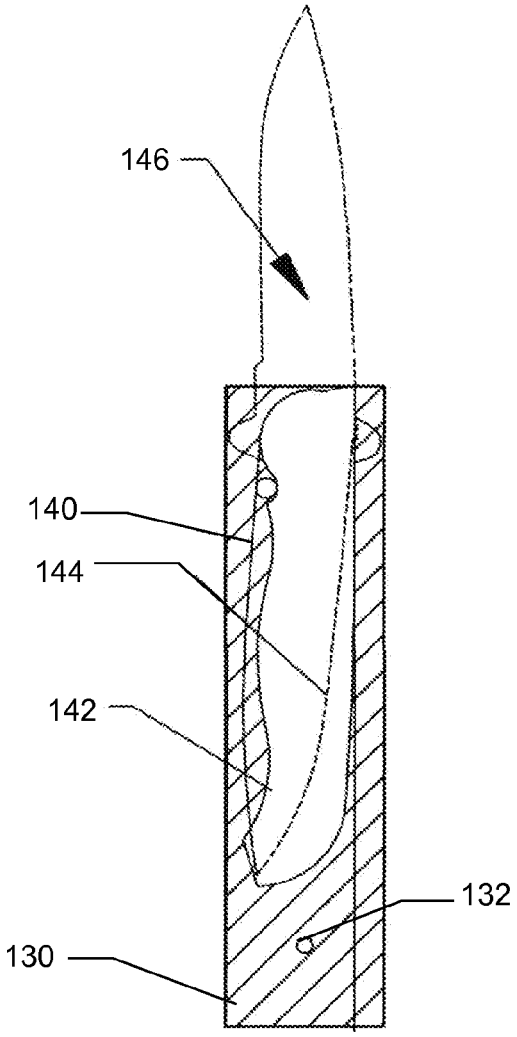
FIG. 4A depicts a front view of a knife holder.
Figure 4B:
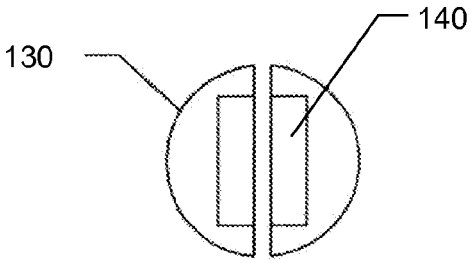
FIG. 4B depicts a top view of a knife holder.
Figure 4C:
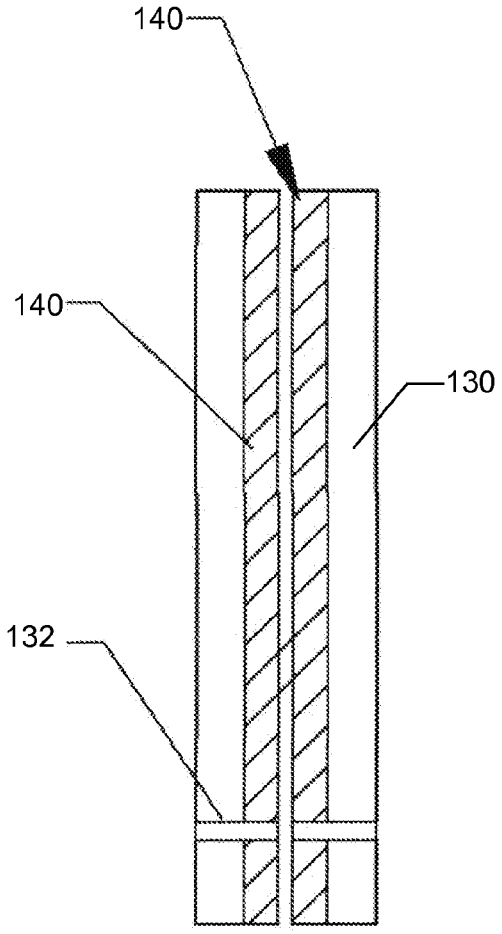
FIG. 4C depicts a side view of a knife holder.

FIGS. 4A-4C depict close up views of the knife holder 130. In some embodiments, the knife holder 130 can have a milled area 140 that can accept a knife 142 in a closed position 144 with the knife's blade inside the knife holder 130 or in an open position 146 with the knife's blade extending beyond the knife holder 130. The knife 142 can be any type of knife, such as a commercially available hunting knife or a knife of custom fabrication. By way of a non-limiting example, in some embodiments the knife 142 can be a CRKT M-16 01KZ knife. In some embodiments, the milled area 140 can comprise a deformable material such as foam, such that the milled area 140 can accept any type of knife 142. In some embodiments, the knife 142 can be provided with the hiking staff 100, while in other embodiments the knife 142 can be provided by a user.

In some embodiments, the knife 142 can be removed from the milled area 140 of the knife holder 130 and reinserted in the desired position 144 or 146. In some situations and/or embodiments, a user can desire to keep the knife 142 secured in the closed position 144 when not in use, but in the open position 146 to use the knife 142 as a spear point for protection, for hunting for food, or for any other reason. In some embodiments, the upper staff section 104 can be removed from the lower staff section 106, such that the upper staff section 104 coupled with the knife 142 in the open position 146 can be used as a spear that is shorter than the full length of the hiking staff 100.

Figure 5:
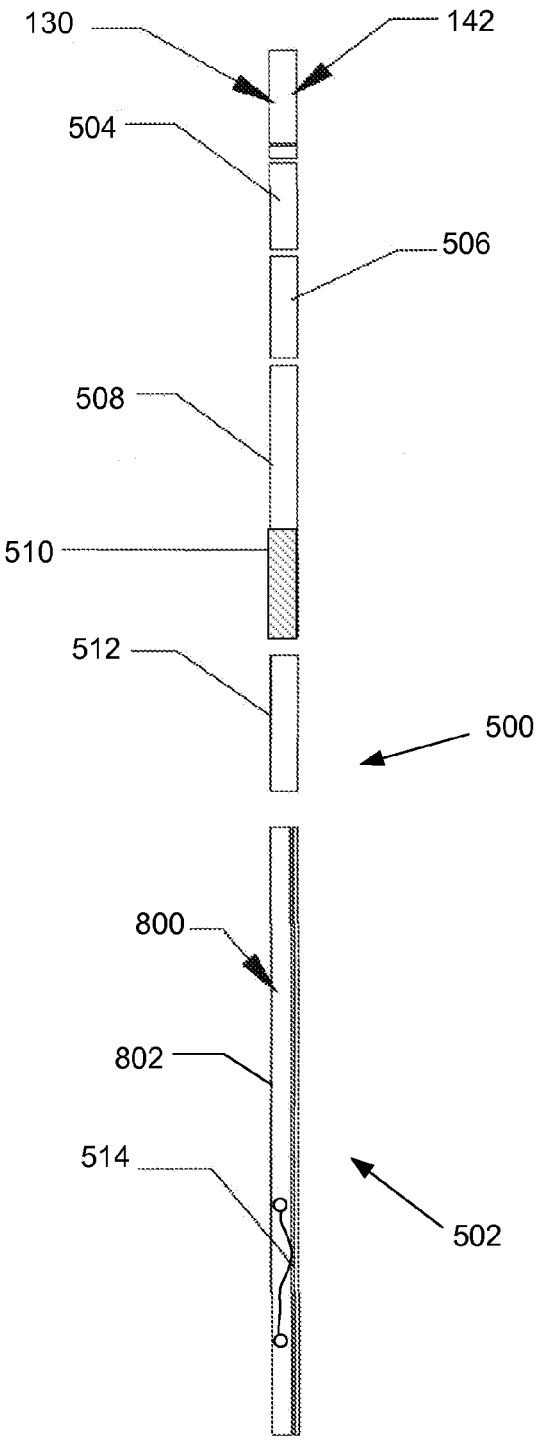
FIG. 5 depicts survival gear in a configuration ready to be stored within a hiking staff.

FIG. 5 depicts survival gear 500. As discussed above, survival gear 500 can be stored within the hollow interiors 108 of the hiking staff 100. In some embodiments, the hiking staff 100 can comprise one or more securing mechanisms inside the hollow interiors 108, configured to secure one or more survival gear 500 items within the hollow interior 108. By way of non-limiting examples, the securing mechanisms can be hooks, knobs, hangers, straps, hook and loop fasteners, nets, elastic, or any other securing mechanisms. In other embodiments, the securing mechanisms can be absent.

The survival gear 500 can include one or more items such as a flashlight, compass, safety pin, lighter, whistle, fish hook, fishing line, sinker, fishing fly, sleeping bag, rope, cording, antibiotic, alcohol prep pad, hydrocortisone, antiseptic towelette, bandages, athletic wrap, sanitary wipes, hand lotion, body lotion, ring saw, tent, tent accessories, personal medications, water purification tablets or devices, filters, tarpaulin, mirror, poncho, bags, thermal blanket, hygiene items, or any other first aid equipment, shelter item, defense item, food gathering item, or other desired item. Some of the survival gear 500 items can be inherently small enough to fit inside the hollow interiors 108 of the hiking staff 100. Others of the survival gear 500 items can be rolled, folded, compressed, wrapped, deflated, compacted, or otherwise manipulated to fit into and/or be stuffed into the hollow interiors 108. In some embodiments, the survival gear 500 items can comprise materials selected to allow the survival gear 500 items to be manipulated to fit inside the space of the hollow interiors 108.

In some embodiments, a selection of survival gear 500 suitable to be stored within the hollow interiors 108 of the hiking staff 100 can be included with the hiking staff 100 as a kit. By way of a non-limiting example, as shown in FIG. 5 a kit 502 can include a selection of survival gear items including: a knife 142; a knife holder 130; a flashlight 504; a container 506 containing a compass, safety pin, lighter, whistle, fish hook, line, and sinker; a sleeping bag 508, such as, by way of non-limiting examples, a SOL® Bivvy Sleeping Bag, or other emergency sleeping bags made of thin and/or light-weight material; a rope 510; a first aid kit 512 comprising bandages, antibiotic, and elastic wrap; a tent 800; one or more tent accessories 802; and a ring saw 514.

Figure 6:
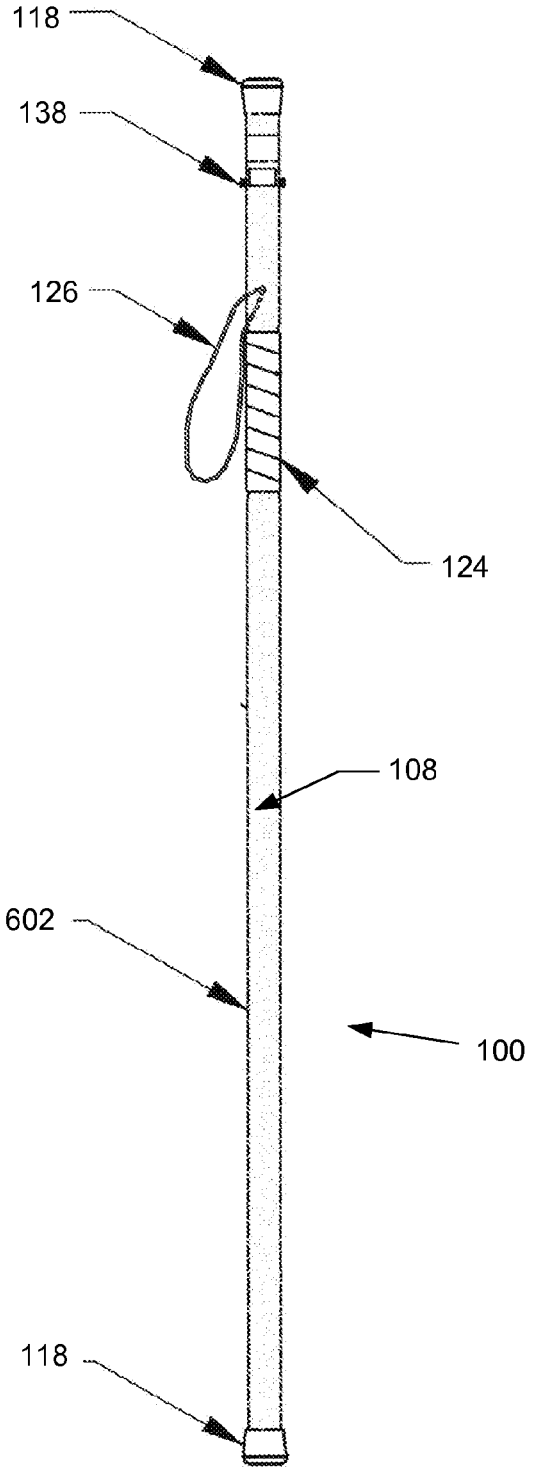
FIG. 6 depicts an external profile view of a hiking staff having one unitary segment.

FIG. 6 depicts an alternate embodiment of a hiking staff 100 comprising one unitary staff section 602. The unitary staff section 602 can be similar to the staff sections 102, but extend along the entire length of the hiking staff 100. The unitary staff section 602 can have a hollow interior 108 for storing survival gear 500. The unitary staff section 602 can have one or more open ends that can be covered by selectively removable end caps 118. In some embodiments, a knife holder 130 can be coupled with the hollow interior 108 of the unitary staff section 602. In some embodiments, the unitary staff section 602 can comprise a handle portion 124 and/or a strap 126.

Figure 7:
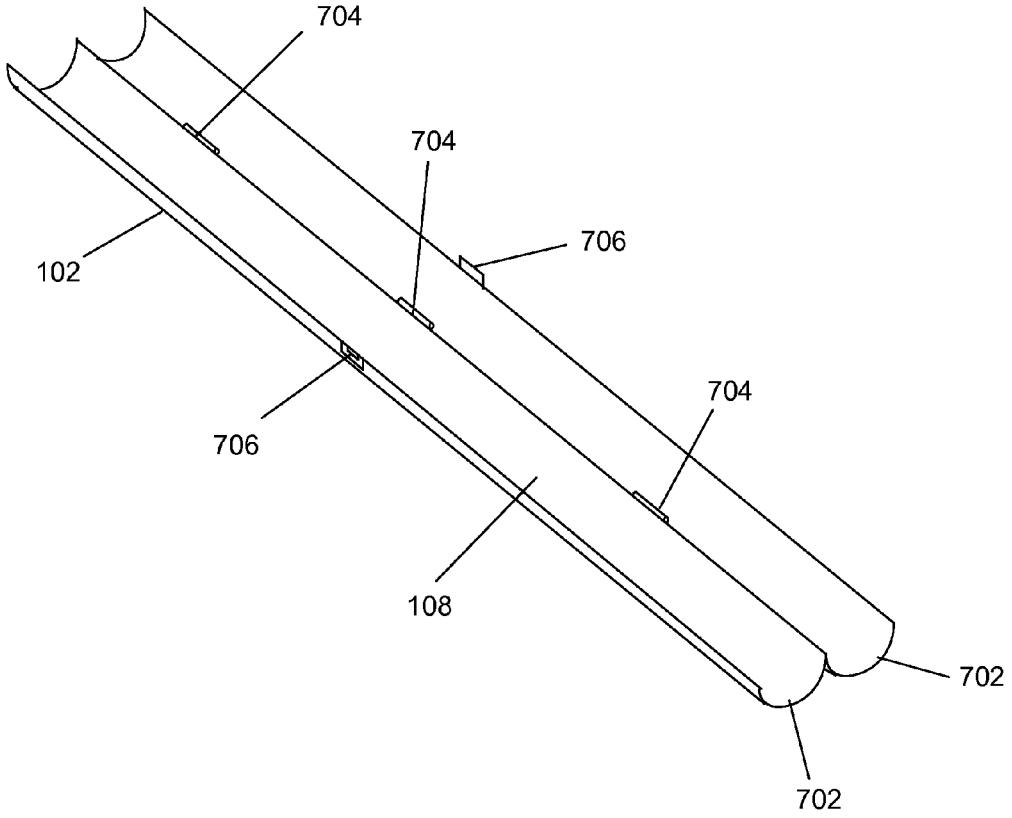
FIG. 7 depicts an isometric view of an embodiment of a hiking staff with hinges.

FIG. 7 depicts an alternate embodiment of a hiking staff 100 in which the staff sections 102 or unitary staff section 602 are split longitudinally into two halves 702. Each half 702 can be coupled with the other half 702 along one seam by hinges 704 and on the other seam by a latch 706. The halves 702 can be rotated about the hinges 704 to allow access to the hollow interior 108 of the staff sections 102 or unitary staff section 602. As discussed above, survival gear 500 can be stored within the hollow interiors 108.

FIGS. 8A-8F depict views of an embodiment of a tent 800 that can be stored inside a hollow interior 108 of the hiking staff 100. In some embodiments, the tent 800 can be included in a kit with the hiking staff 100, such as the kit 502. The tent 800 can be made of a material that can be folded and/or rolled tightly enough to fit within a hollow interior 108 of the hiking staff 100, such as nylon fabric or any other strong yet light-weight fabric. In some embodiments, the tent 800 can be made of a waterproof material.

In some embodiments, the tent 800 can comprise access flaps 804 secured with cording through eyelets 806 on the access flap 804. The tent 800 can have one or more channels 808 extending along the top circumference of the front, back, and/or middle of the tent 800. In some embodiments, the channels 808 can be made of the same material as the tent 800, but in other embodiments can be made of a different material. The channels 808 can be coupled with the tent using stitching, fusing, adhesives, or any other connection method. By way of a non-limiting example, the channels 808 can be sewn to the tent 800 with high strength water and mold resistant stitching. In other embodiments the channels 808 can be integral with the tent 800. In some embodiments, the tent 800 can also have tent flanges 810 extending along the length of the sides of the tent 800 at the base of the tent 800. The tent flanges 810 can be extensions extending away from the base of the tent 800.

The tent 800 can be assembled using tent accessories 802. In some embodiments, tent accessories 802 can be one or more of a plurality of frames 812, tent stakes 814, couplers 816, cords 818, and/or ground stakes 820. In some embodiments, the frames 812 can comprise a plurality of frame pieces 822 and a plurality of tension couplers 824. In some embodiments, the frame pieces 822 can be made of ⅛ inch flat stainless spring steel. In alternate embodiments, the frames pieces 822 can be made of round spring wire, or any other material. The tension couplers 824 can be made of rigid steel, or any other desired material. In alternate embodiments, the frames 812 can be full length spring steel. The tent stakes 814 and the ground stakes 820 can be made of aluminum, plastic, wood, metal, or any other material. By way of a non-limiting example, in some embodiments the tent stakes 814 and/or the ground stakes 820 can be #8 all-thread tent stakes. The couplers 816 can be any desired size or type of coupler. By way of a non-limiting example, in some embodiments the couplers 816 can be 1.5 inch deep×#8 hex nut couplers. By way of another non-limiting example, in other embodiments the couplers 816 can be aluminum screw posts. In some embodiments, the cords 818 can be rope. In other embodiments, the cords 818 can be string, cable, or any other type of cord.

Figure 8A:
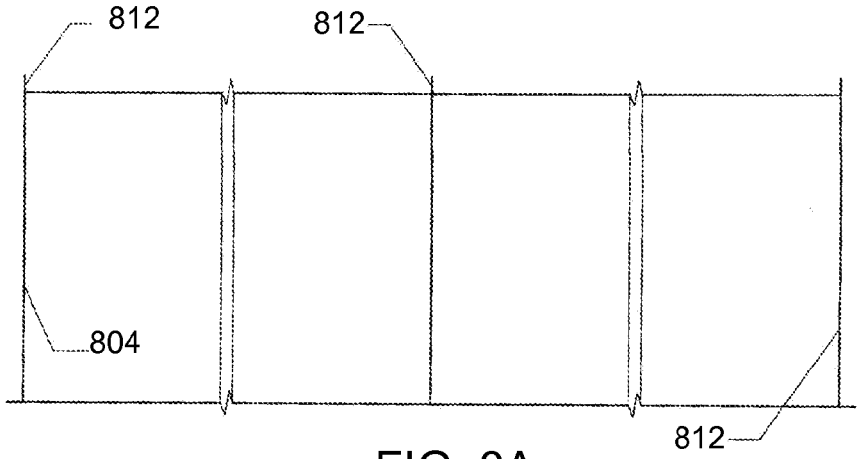
FIG. 8A depicts a side view of a tent.
Figure 8B:
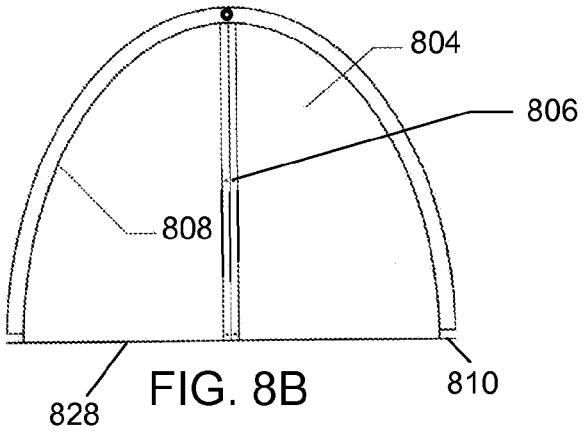
FIG. 8B depicts a front view of a tent.
Figure 8C:
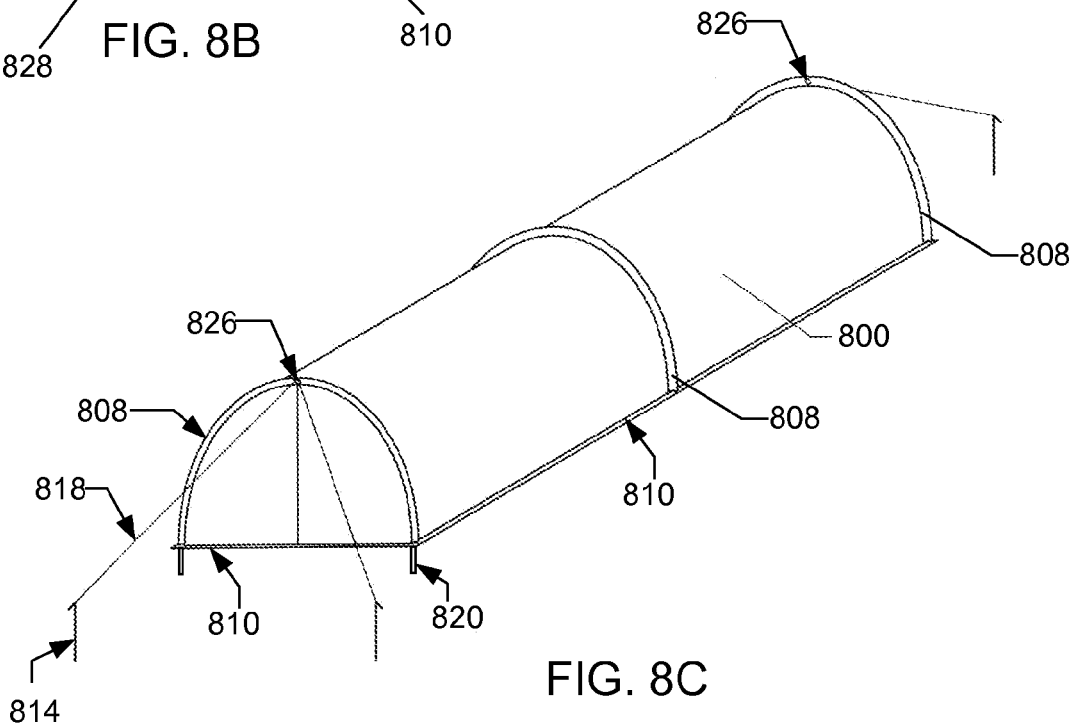
FIG. 8C depicts an isometric view of a tent.
Figure 8D:
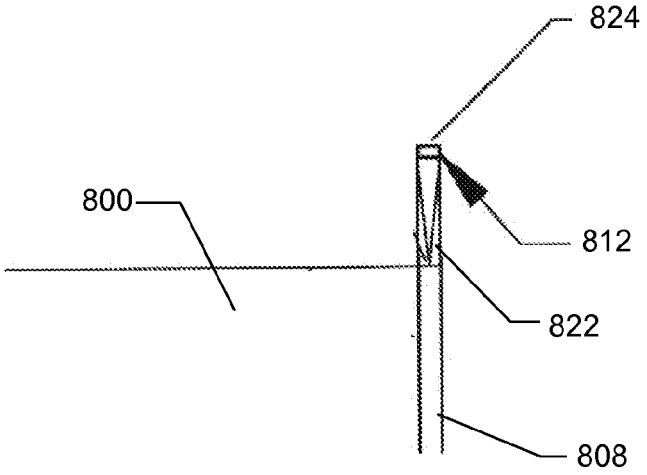
FIG. 8D depicts details of a tent frame and seamed tent frame channel.
Figure 8E:
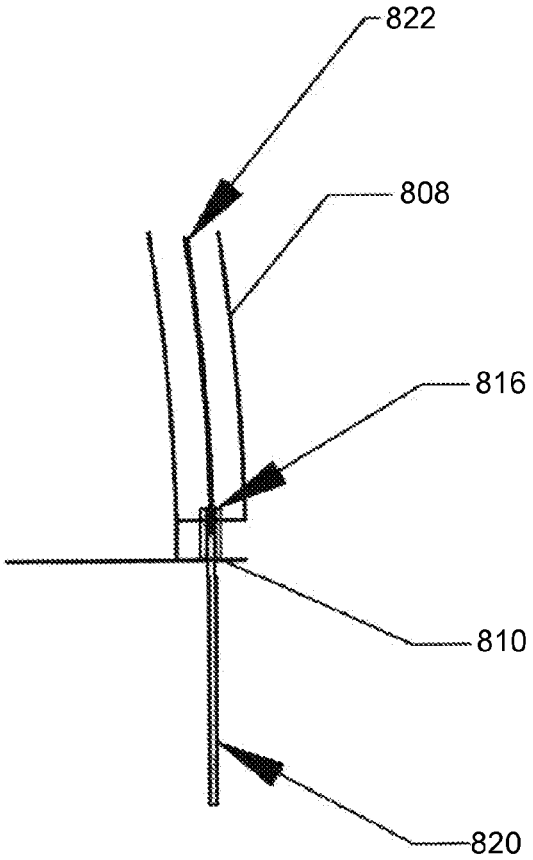
FIG. 8E depicts a front view of a tent with details of a ground stake, coupler and frame.
Figure 8F:
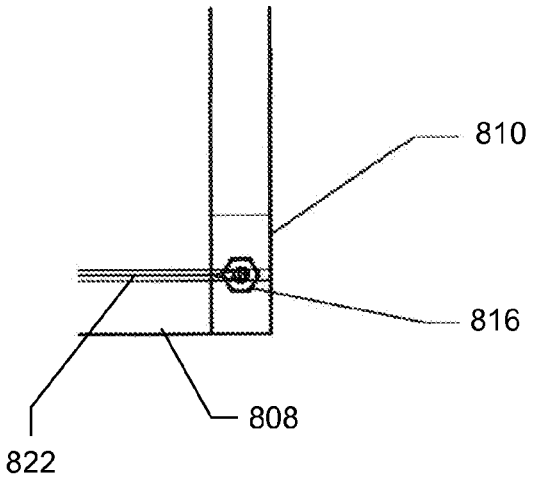
FIG. 8F depicts a top view of a tent with details of a frame, coupler, and flange.
Figure 9:
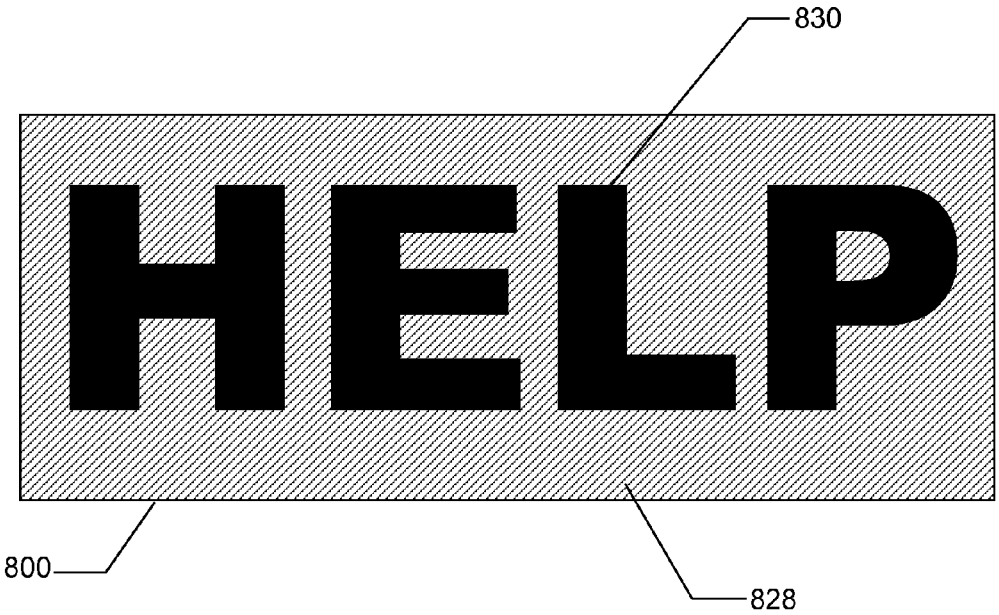
FIG. 9 depicts a view of the bottom of a tent.

In operation, the frames 812 can be assembled by coupling two frame pieces 822 together with a tension coupler 824. In some embodiments, three frames 812 can be used and can each be inserted into the channels 808 extending along the front, back, and middle of the tent 800, as shown in FIG. 8C. The tent 800 can be anchored to the ground using the ground stakes 820, as shown in FIG. 8E. The couplers 816 can be used to secure the tent flanges 810 to the ground stakes 820 and allow the bottom portion of the frames 812 to be retained in the unused open portion of the couplers 816. The couplers 816 can be adjustable to prevent withdrawal of the frames 812 from the ground stakes 820. The tent stakes 814 can be driven into the ground away from the tent 800. The frames 812 can be held in place at each end of the tent 800 by tying cords 818 from the tent stakes 814 to the crown 826 of the tent 800.

In some embodiments, the bottom surface 828 of the tent 800 can display a message 830. In some embodiments, the message 830 can be the word "HELP." In some embodiments, the bottom surface 828 of the tent 800 can be made of red waterproof nylon fabric and the word "HELP" can be emblazoned in white. In alternate embodiments, the bottom surface 828 of the tent 800 can have any colors and/or message 830 as desired. In operation, the bottom surface 828 of the collapsed tent 800 can be placed face up in an open area, such that the message 830 is displayed toward the sky, for example when a hiker is seeking help from an aerial craft.

While in some embodiments the tent 800 can be designed to collapse and be stored inside the hiking staff 100, in other embodiments the tent 800 can be otherwise folded or collapsed to be carried in a container apart from the hiking staff 100. By way of a non-limiting example, the tent 800 can be stored and carried in a fanny pack, thereby allowing the hollow interiors 108 of the hiking staff 100 to be filled with other survival gear 500 and/or to be used as alternative additional storage, and/or reducing the weight of the loaded hiking staff 100.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A hiking staff kit, comprising:

a hiking staff comprising one or more staff sections each comprising a hollow interior, an upper end cap removably coupled with an upper open end of said hiking staff, and a lower end cap removably coupled with a lower open end of said hiking staff;

a knife configured to fit within at least one said hollow interior;

a flashlight configured to fit within at least one said hollow interior;

a sleeping bag configured to be collapsible down to a size such that said sleeping bag fits within at least one said hollow interior;

a rope configured to be collapsible down to a size such that said rope fits within at least one said hollow interior;

a first aid kit configured to fit within at least one said hollow interior;

a tent configured to be collapsible down to a size such that said tent fits within at least one said hollow interior; and a ring saw configured to fit within at least one said hollow interior.

2. The hiking staff kit of claim 1, wherein said tent comprises a bottom surface that displays a survival message.

3. The hiking staff kit of claim 1, wherein said hiking staff further comprises:

a knife holder coupled with one of said one or more staff sections, said knife holder being housed inside at least one said hollow interior, and said knife holder being configured to accept and retain said knife alternately in a first position and a second position, wherein in said first position a blade of said knife extends out from said upper open end with said upper end cap removed, and wherein in said second position said blade is reversed from said first position and is held entirely within at least one said hollow interior.

* * * * *